US006227191B1

(12) United States Patent
Garloch

(10) Patent No.: US 6,227,191 B1
(45) Date of Patent: May 8, 2001

(54) METHOD AND APPARATUS FOR ADJUSTING AIRFLOW IN DRAFT INDUCER

(75) Inventor: Duane David Garloch, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/653,599

(22) Filed: Aug. 31, 2000

(51) Int. Cl.[7] ..... F24H 3/02

(52) U.S. Cl. ..... 126/110 R; 126/80; 126/312

(58) Field of Search ..... 126/110 R, 99 R, 126/116 A, 80, 312, 307 R, 290, 289, 85 B, 116 R, 110 C; 110/160, 162, 163, 147

(56) References Cited

U.S. PATENT DOCUMENTS 2,504,315 * 4/1950 Feuerfile ..... 126/110 R
4,289,730 * 9/1981 Tomlinson ..... 126/110 R
5,255,665 * 10/1993 Windon ..... 126/312
5,368,010 * 11/1994 Weber, III et al. ..... 126/110 R
5,941,230 * 8/1999 Rutz et al. ..... 126/312

* cited by examiner

*Primary Examiner*—James C. Yeung
(74) *Attorney, Agent, or Firm*—Wall Marjama & Bilinski

(57) ABSTRACT

A bypass hole is cut into a collector box cover to reduce the efficiency of a draft inducer fan when the fan is used with a furnace containing fewer burner-heat exchanger cells than the fan is optimally suited for. Thus the same inducer fan can be used for both a two-cell and three-cell furnace. A method for adjusting airflow in a draft inducer for a furnace includes collecting flue gasses from the heat exchanger cells, inducing a draft by moving the flue gasses from a collector box, through a housing, and out of an exhaust hole, and taking a portion of the flue gasses in the housing and re-entering the portion of flue gasses into the collector box instead of exhausting the portion of said flue gasses to the outside.

14 Claims, 4 Drawing Sheets

METHOD AND APPARATUS FOR ADJUSTING AIRFLOW IN DRAFT INDUCER

FIELD OF THE INVENTION

The invention pertains to the field of high efficiency gas furnaces, and in particular to a high efficiency gas furnace that includes a draft inducer.

BACKGROUND OF THE INVENTION

In general terms, furnaces such as those commonly installed to heat homes operate by drawing air from the living area through the furnace, heating the air, and returning it to the living area. In some heating systems, the air drawn from the living area is also used for combustion before being vented to the outside. Other systems draw combustion air from the outside. Duct systems are generally used to move the air, both heated and unheated, from one location to another. A blower forces the air drawn from the living area for heating through at least one heat exchanger. Usually, more than one heat exchanger is utilized. The heat exchangers are heated by combustion product gases generated by burners in a burner assembly, with each burner aligned with the inlet to one heat exchanger. The burners allow combustion of the gas and direct heated flue gas into the heat exchangers.

The typical heat exchanger includes cells with a channel or pass formed in each cell to direct the flow of flue gas produced by combustion and can be formed from sheet steel ("clamshell" exchangers) or steel tubing ("tubular" exchangers). These cells are typically positioned side by side in a parallel manner and include a predetermined spacing to allow the blower air to flow around the cells. The blower air is thus heated as it circulates over the cells.

When the flue gasses exit the heat exchangers, they are gathered in a collector box. The flue gases are typically withdrawn from the collector box by a draft inducer and ducted to the outside via a flue vent.

Each burner-heat exchanger pair are referred to as a "cell." The larger the furnace, the more cells it contains. Small furnaces typically contain a minimum of two cells. Draft inducers are sized to optimize combustion efficiency. A draft inducer sized for a two-cell furnace does not optimize combustion efficiency for a three-cell furnace, and vice versa. That is, a draft inducer sized for a three-cell furnace is too strong for a two-cell furnace and decreases the efficiency of the furnace. In a product line that includes two-cell through seven-cell furnaces, six different size draft inducers are needed. A need therefore exists to reduce the number of different size draft inducers required for the product line.

SUMMARY OF THE INVENTION

Briefly stated, a bypass hole is cut into a collector box cover to reduce the efficiency of a draft inducer fan when the fan is used with a furnace containing fewer burner-heat exchanger cells than the fan is optimally suited for. Thus the same inducer fan can be used for both a two-cell and three-cell furnace. A method for adjusting airflow in a draft inducer for a furnace includes collecting flue gasses from the heat exchanger cells, inducing a draft by moving the flue gasses from a collector box, through a housing, and out of an exhaust hole, and taking a portion of the flue gasses in the housing and re-entering the portion of flue gasses into the collector box instead of exhausting the portion of said flue gasses to the outside.

According to an embodiment of the invention, an apparatus for adjusting airflow in a draft inducer for a furnace includes a draft inducer, the draft inducer including a housing; a collector box for collecting flue gasses from a plurality of heat exchangers in the furnace; the collector box including a cover disposed adjacent the draft inducer housing; the cover having an inducer housing inlet; the draft inducer housing having an exhaust hole; moving means for moving the flue gasses from the collector box, through the housing, and out of the exhaust hole; and the cover having at least one bypass hole therein, whereby a portion of the flue gasses in the housing re-enter the collector box via the bypass hole.

According to an embodiment of the invention, an apparatus for adjusting airflow in a draft inducer for a furnace includes a draft inducer, the draft inducer including a housing; a collector box for collecting flue gasses from a plurality of heat exchangers;

a collector box cover disposed between the collector box and the draft inducer housing; the cover having an inducer housing inlet; the draft inducer housing having an exhaust hole; moving means for moving the flue gasses from the collector box, through the housing, and out of the exhaust hole; the cover having at least one bypass hole therein, whereby a portion of the flue gasses in the housing re-enter the collector box via the bypass hole; wherein a location of the bypass hole is offset from an end of any of the plurality of heat exchangers; wherein a location of the bypass hole is such that a positive pressure differential exists between the flue gasses in the draft inducer housing and the collector box; and wherein, when the furnace has a specified number of cells, each cell including one heat exchanger, and the moving means is optimized for the specified number of cells with a collector box cover having no bypass hole, the bypass hole optimizes the moving means for the furnace when the furnace has at least one less cell than the specified number of cells.

According to an embodiment of the invention, a method for adjusting airflow in a draft inducer for a furnace includes collecting flue gasses from a plurality of heat exchangers in the furnace; inducing a draft by moving the flue gasses from a collector box, through a housing, and out of an exhaust hole; and taking a portion of the flue gasses in the housing and re-entering the portion of the flue gasses into the collector box instead of exhausting the portion of the flue gasses.

DETAILED DESCRIPTION OF THE PREFERRED EMBODIMENT

Figure 1:
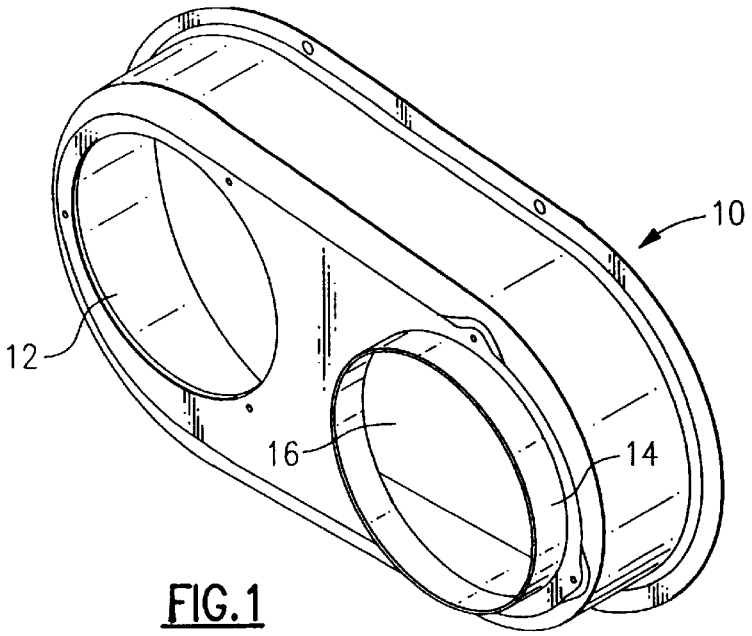
FIG. 1 shows a draft inducer housing for a furnace used in conjunction with an embodiment of the present invention.
Figure 4:
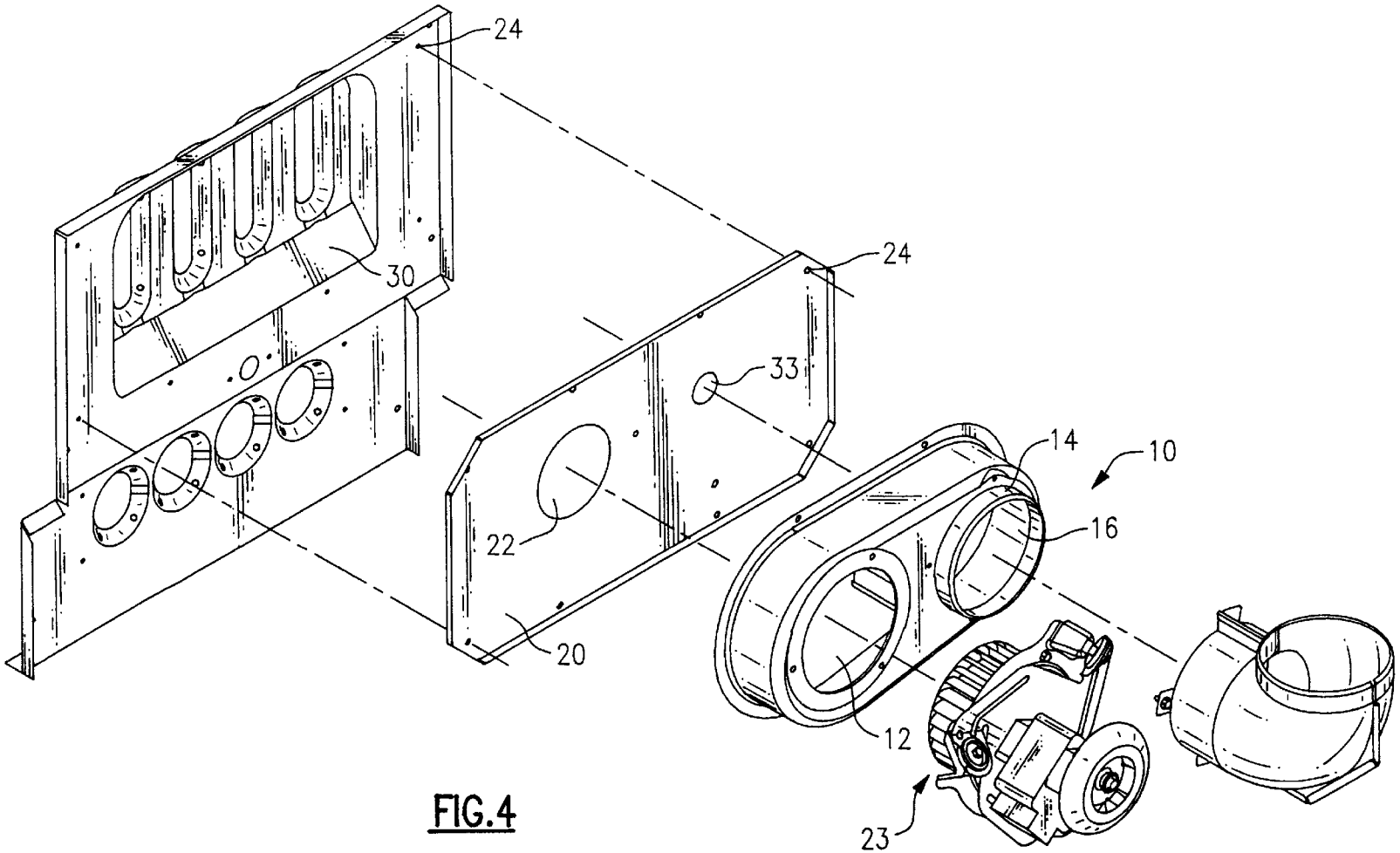
FIG. 4 shows an exploded view of the collector box, collector box cover, draft inducer housing, draft inducer fan, and vent elbow incorporating an embodiment of the present invention.

Referring to FIG. 1, a draft inducer housing 10 is shown. A section 12 receives an inducer fan 23 (FIG. 4). A mounting 14 permits mounting a vent to exhaust flue gasses through an exhaust hole 16.

Figure 2:
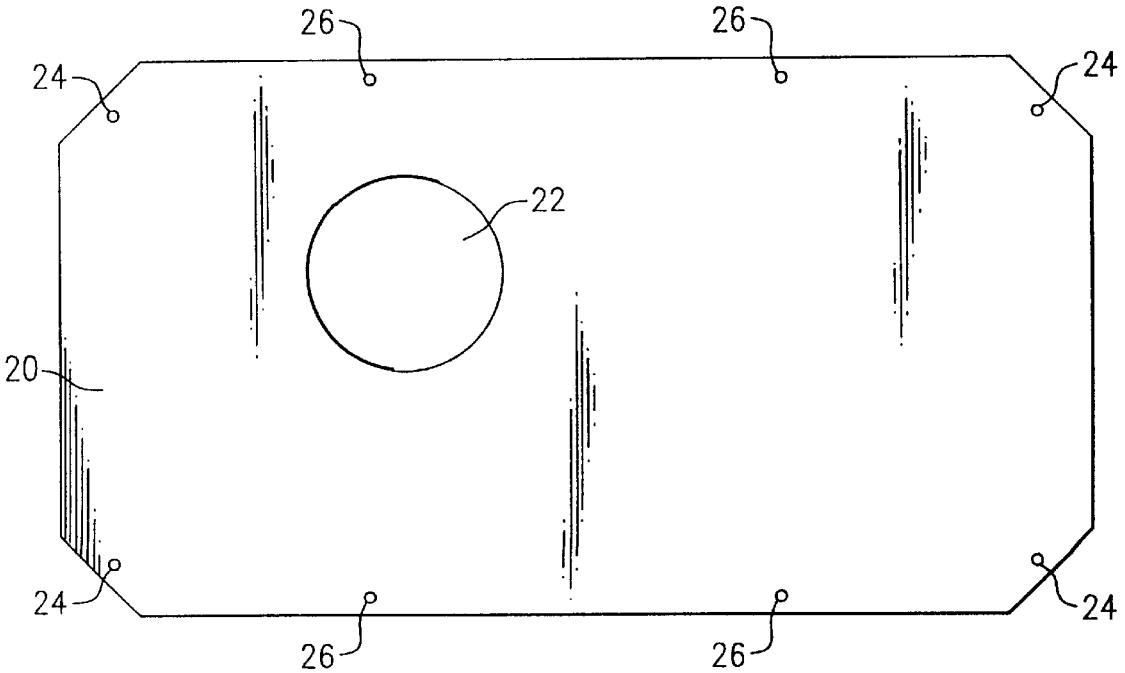
FIG. 2 shows a collector box cover that fits between the draft inducer housing of FIG. 1 and a collector box.
Figure 3:
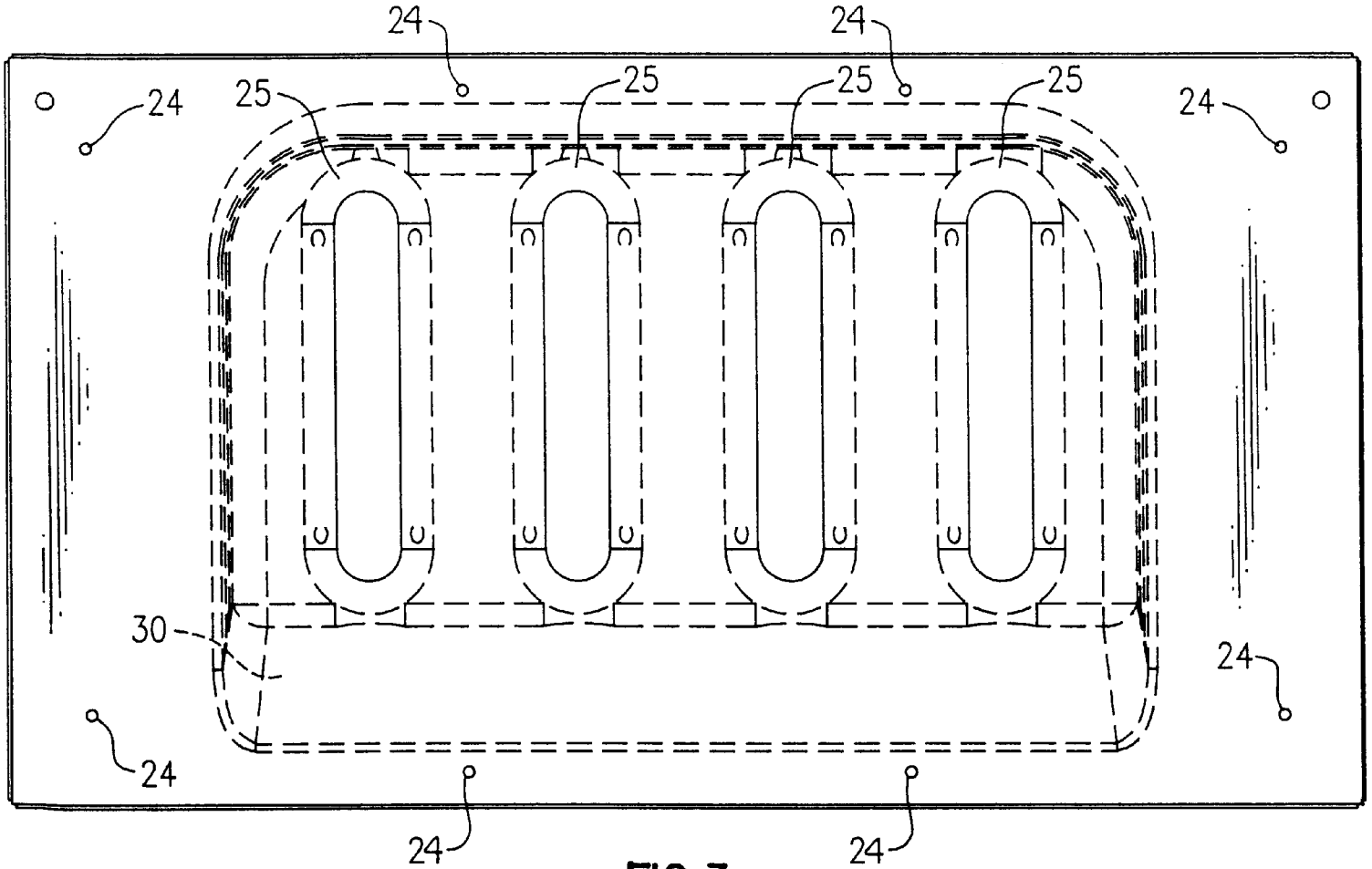
FIG. 3 shows a top view of a collector box for a furnace that collects flue gasses from a plurality of heat exchangers.

Referring also to FIGS. 2–3, housing 10 is mounted onto a collector box cover 20. Housing 10 and collector box cover 20 are preferably of aluminized steel. An inducer housing inlet 22 permits flue gasses passing from a plurality of heat exchangers 25 (FIG. 3) into a collector box 30 to be drawn into draft inducer housing 10 by inducer fan 23 (FIG. 4) and exhausted through exhaust hole 16. Collector box cover 20 is attached to collector box 30 via a plurality of mechanical fasteners 24. Housing 10 is attached to collector box cover 20 in like fashion. Note that four heat exchangers are depicted in FIG. 3, thus indicating a four-cell furnace. Inducer fan 23 (FIG. 4) is sized according to the number of cells, four in this case.

Referring to FIG. 4, a bypass hole 33 is added to collector box cover 20 to permit the same inducer fan 23 used for the four-cell furnace of FIG. 3 to be used with a three-cell configuration. In the prior art, inducer housing inlet 22 would be made a different size for a three-cell configuration. In the present invention, the size of inducer housing inlet 22 remains the same for both three-cell and four-cell configurations because the addition of bypass hole 33 adjusts the inducer housing airflow from collector box 30.

The pressure in inducer housing 10 is higher than the pressure in collector box 30. Placing bypass hole 33 in collector box cover 20 between collector box 30 and housing 10 causes some of the flue gasses leaving inducer housing 10 to re-enter collector box 30 through bypass hole 33 due to the pressure difference. This recirculation of the flue gasses reduces the efficiency of draft inducer 10, thus permitting the same inducer fan to be used for both the three-cell and four-cell configuration. The same holds true for any configurations that vary by at least one cell. That is, the same inducer fan can be used for two-cell and three-cell configurations if bypass hole 33 is in the collector box cover 20 of the two-cell configuration. In similar fashion, the same inducer fan can be used for three-cell and four-cell configurations, four-cell and five-cell configurations, five-cell and six-cell configurations, and six-cell and seven-cell configurations, respectively.

With a furnace product line running between two-cell and seven-cell configurations, one inducer fan is preferably used for two-cell and three-cell configurations, another inducer fan is used for four-cell and five-cell configurations, and a third inducer fan is used for six-cell and seven-cell configurations, as long as bypass hole 33 is in the collector box cover 20 of the even numbered cell configuration. Thus, only three different sizes of inducer fans and two different collector box covers are needed to handle six different sizes of furnaces. It is also possible to use one size inducer fan with six different size collector boxes. For example, if the motor is sized for a seven-cell furnace, a bypass hole 33 is used in collector box cover 20 when the same motor is used for a six-cell furnace, while a larger bypass hole 33 or an additional bypass hole 33 is used on a five-cell furnace, and so on, increasing the size of bypass hole 33 or adding additional bypass holes 33 as necessary.

The precise location of bypass hole 33 in collector box cover 20 can be anywhere a positive pressure differential exists between the flue gasses in housing 10 and collector box 30. Bypass hole 33 is preferably located offset from a heat exchanger 25, i.e., not right in front of a heat exchanger 25. One bypass hole or a plurality of bypass holes can be used.

Figure 5:
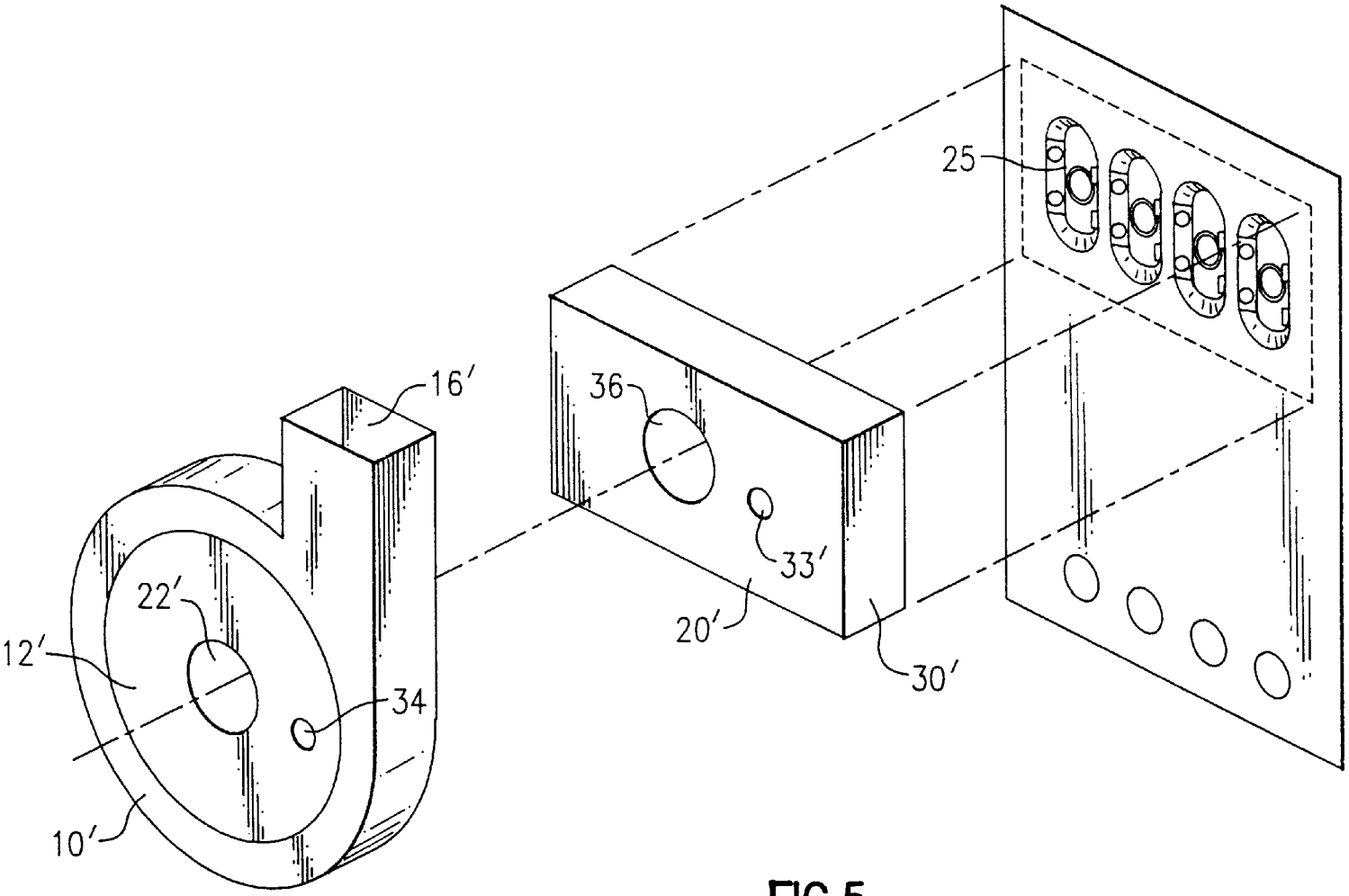
FIG. 5 shows an exploded view of a collector box and cover and draft inducer housing incorporating an embodiment of the present invention.

Referring to FIG. 5, the present invention is readily adapted to a different type of draft inducer housing. An inducer housing 10' fits over a collector box 30'. Collector box 30' fits over a plurality of heat exchangers 25. Collector box 30' includes a venting hole 36 which aligns with an inducer housing inlet 22'. Inducer housing 10' includes a section 12' for mounting an inducer fan (not shown). Flue gasses are exhausted from heat exchangers 25 and collector box 30' by the inducer fan and exhausted through an exhaust hole 16'. A bypass hole 33' in a cover 20' of collector box 30' and a corresponding bypass hole 34 in inducer housing 10' perform the same function as bypass hole 33 previously described in the previous embodiments.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. An apparatus for adjusting airflow in a draft inducer for a furnace, comprising:

a draft inducer, said draft inducer including a housing;

a collector box for collecting flue gasses from a plurality of heat exchangers in said furnace;

said collector box including a cover disposed adjacent said draft inducer housing;

said cover having an inducer housing inlet;

said draft inducer housing having an exhaust hole;

moving means for moving said flue gasses from said collector box, through said housing, and out of said exhaust hole; and said cover having at least one bypass hole therein, whereby a portion of said flue gasses in said housing re-enter said collector box via said at least one bypass hole.

2. An apparatus according to claim 1, further including at least one bypass hole in said inducer housing in fluid communication with said at least one bypass hole in said cover.

3. An apparatus according to claim 2, wherein a location of said bypass hole is offset from an end of any of said plurality of heat exchangers.

4. An apparatus according to claim 2, wherein a location of said bypass hole is such that a positive pressure differential exists between said flue gasses in said draft inducer housing and said collector box.

5. An apparatus according to claim 2, wherein, when said furnace has a specified number of cells, each cell including one heat exchanger, and said moving means is optimized for said specified number of cells with a collector box cover having no bypass hole, said bypass hole optimizes said moving means for said furnace when said furnace has at least one less cell than said specified number of cells.

6. An apparatus according to claim 1, wherein a location of said bypass hole is offset from an end of any of said plurality of heat exchangers.

7. An apparatus according to claim 1, wherein a location of said bypass hole is such that a positive pressure differential exists between said flue gasses in said draft inducer housing and said collector box.

8. An apparatus according to claim 1, wherein, when said furnace has a specified number of cells, each cell including one heat exchanger, and said moving means is optimized for said specified number of cells with a collector box cover having no bypass hole, said bypass hole optimizes said moving means for said furnace when said furnace has at least one less cell than said specified number of cells.

9. An apparatus for adjusting airflow in a draft inducer for a furnace, comprising:

a draft inducer, said draft inducer including a housing;

a collector box for collecting flue gasses from a plurality of heat exchangers;

said collector box including a cover disposed adjacent said draft inducer housing;

said cover having an inducer housing inlet;

said draft inducer housing having an exhaust hole;

moving means for moving said flue gasses from said collector box, through said housing, and out of said exhaust hole;

said cover having at least one bypass hole therein, whereby a portion of said flue gasses in said housing re-enter said collector box via said bypass hole;

wherein a location of said bypass hole is offset from an end of any of said plurality of heat exchangers;

wherein a location of said bypass hole is such that a positive pressure differential exists between said flue gasses in said draft inducer housing and said collector box; and wherein, when said furnace has a specified number of cells, with each cell including one heat exchanger, and said moving means is optimized for said specified number of cells with a collector box cover having no bypass hole, said bypass hole optimizes said moving means for said furnace when said furnace has at least one less cell than said specified number of cells.

10. A method for adjusting airflow in a draft inducer for a furnace, comprising the steps of:

collecting flue gasses from a plurality of heat exchangers in said furnace;

inducing a draft by moving said flue gasses from a collector box, through a housing, and out of an exhaust hole; and taking a portion of said flue gasses in said housing and re-entering said portion of said flue gasses into said collector box instead of exhausting said portion of said flue gasses.

11. A method according to claim 10, wherein said portion of said flue gasses re-enter said collector box through a bypass hole.

12. A method according to claim 11, further comprising locating said bypass hole offset from an end of any of said plurality of heat exchangers.

13. A method according to claim 11, further comprising locating said bypass hole such that a positive pressure differential exists between said flue gasses in said housing and said collector box.

14. A method according to claim 11, wherein, when said furnace has a specified number of cells, each cell including one heat exchanger, and said step of inducing a draft is optimized for said specified number of cells with a collector box cover having no bypass hole, said bypass hole optimizes said step of inducing a draft for said furnace when said furnace has at least one less cell than said specified number of cells.

* * * * *